US009220146B2

(12) United States Patent
Hu

(10) Patent No.: US 9,220,146 B2
(45) Date of Patent: Dec. 22, 2015

(54) LIGHT EMITTING DIODE DRIVER WITH LINEARLY CONTROLLED DRIVING CURRENT

(71) Applicant: Cree, Inc., Durham, NC (US)

(72) Inventor: Yuequan Hu, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/932,717

(22) Filed: Jul. 1, 2013

(65) Prior Publication Data

US 2015/0002049 A1 Jan. 1, 2015

(51) Int. Cl.
*H05B 37/02* (2006.01)
*H05B 33/08* (2006.01)

(52) U.S. Cl.
CPC ..... *H05B 33/0848* (2013.01)

(58) Field of Classification Search
CPC ..... H05B 37/00; H05B 37/02; H05B 37/0245
USPC ..... 315/291, 294, 297, 307, 308
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 7,781,982 | B2 * | 8/2010 | Tatsumi | 315/291 |
| 8,294,375 | B2 * | 10/2012 | Lee | 315/186 |
| 2005/0162098 | A1 | 7/2005 | Ball | |
| 2006/0279236 | A1 | 12/2006 | Johnson et al. | |
| 2009/0187925 | A1 | 7/2009 | Hu et al. | |
| 2009/0218960 | A1 * | 9/2009 | Lyons et al. | 315/297 |
| 2011/0266967 | A1 * | 11/2011 | Bordin et al. | 315/287 |
| 2012/0019155 | A1 * | 1/2012 | Chen et al. | 315/186 |
| 2012/0081017 | A1 | 4/2012 | Darshan et al. | |
| 2013/0134892 | A1 * | 5/2013 | Kado et al. | 315/206 |

OTHER PUBLICATIONS

International Search Report and Written Opinion for corresponding PCT International Application No. PCT/US2014/044819, mailed Nov. 7, 2014 (10 pages).

* cited by examiner

*Primary Examiner* — Tung X Le
(74) *Attorney, Agent, or Firm* — Myers Bigel Sibley & Sajovec, P.A.

(57) ABSTRACT

A driver circuit for a lighting apparatus includes a current regulator configured to supply a load current to a load, and a control circuit coupled to the current regulator and configured to receive a dimming control signal and to linearly vary an amplitude of the load current in response to the dimming control signal.

18 Claims, 13 Drawing Sheets

LIGHT EMITTING DIODE DRIVER WITH LINEARLY CONTROLLED DRIVING CURRENT

BACKGROUND

The present disclosure generally relates to LED drivers, and more particularly, to an LED driver with linearly controlled dimming.

As a result of continuous technological advances that have brought about remarkable performance improvements, light-emitting diodes (LEDs) are increasingly finding applications in traffic lights, automobiles, general-purpose lighting, and liquid-crystal-display (LCD) backlighting. As solid state light sources, LED lighting is poised to replace existing lighting sources such as incandescent and fluorescent lamps in the future since LEDs do not contain mercury, exhibit fast turn-on and dimmability, and long life-time, and require low maintenance. Compared to fluorescent lamps, LEDs can be more easily dimmed either by linear dimming or PWM (pulse-width modulated) dimming.

A light-emitting diode (LED) is a semiconductor device that emits light when its p-n junction is forward biased. While the color of the emitted light primarily depends on the composition of the material used, its brightness is directly related to the level of current flowing through the junction. Therefore, it is typically desirable for an LED driver circuit to generate a constant current.

SUMMARY

A driver circuit for a lighting apparatus according to some embodiments includes a current regulator configured to supply a load current to a load, and a control circuit coupled to the current regulator and configured to receive a dimming control signal and to linearly vary an amplitude of the load current in response to the dimming control signal.

The control circuit may further include a conversion circuit that is configured to generate a control signal, a current sense circuit that is configured to generate a current sense signal indicative of the amplitude of the load current, and an error amplifier that is configured to receive the control signal and the current sense signal and responsively generate an error signal that controls the current regulator.

The error amplifier may further include an inverting input and a noninverting input, the control signal may be coupled to the inverting input of the error amplifier through a diode and a first resistor, the current sense signal may be coupled to the inverting input of the error amplifier through a second resistor, and a reference voltage may be applied to the noninverting input of the error amplifier.

The dimming control signal may further include a pulse width modulated signal, and the conversion circuit may be configured to receive the pulse width modulated dimming control signal and to generate the control signal in response to the pulse width modulated dimming control signal.

The conversion circuit may further include a detector configured to detect the pulse width modulated dimming control signal and a voltage clamp and filter circuit coupled to the detector and configured to clamp and filter an output of the detector.

The error amplifier may further include an inverting input and a noninverting input, the control signal may be coupled to a first node through a diode and a first resistor, the current sense signal may be coupled to the first node, the first node may be coupled to an input of an amplifier, an output of the amplifier may be coupled to the inverting input of the error amplifier through a second resistor, and a reference voltage may be applied to the noninverting input of the error amplifier.

The error amplifier may further include an inverting input and a noninverting input, the control signal may be coupled to the noninverting input of the error amplifier through a first resistor, and the current sense signal may be coupled to the inverting input of the error amplifier through a second resistor.

The control circuit may further include a microcontroller that is configured to generate a control signal in response to the dimming control signal.

The driver circuit may further include a current sense circuit that is configured to generate a current sense signal indicative of the amplitude of the load current, and an error amplifier that is configured to receive the control signal and the current sense signal and responsively generate an error signal that controls the current regulator.

The error amplifier may further include an inverting input and a noninverting input, the control signal may be coupled to the noninverting input of the error amplifier through a first resistor, and the current sense signal may be coupled to the inverting input of the error amplifier through a second resistor.

The microcontroller may be configured to generate a pulse width modulated control signal in response to the dimming control signal, the control circuit further including a filter configured to convert the pulse width modulated control signal into a voltage control signal.

The microcontroller may be configured to generate the control signal as a voltage control signal.

The driver circuit may further include a current sense circuit that is configured to generate a current sense signal indicative of the amplitude of the load current, and an error amplifier that is configured to receive the control signal and the current sense signal and responsively generate an error signal that controls the current regulator.

The error amplifier may further include an inverting input and a noninverting input, the control signal may be coupled to the noninverting input of the error amplifier through a first resistor, and the current sense signal may be coupled to the inverting input of the error amplifier through a second resistor.

The error amplifier may further include an inverting input and a noninverting input, the control signal may be coupled to the inverting input of the error amplifier through a diode and a first resistor, the current sense signal may be coupled to the inverting input of the error amplifier through a second resistor, and a reference voltage may be applied to the noninverting input of the error amplifier.

The voltage control signal may be provided directly to the current regulator as a current regulator control signal.

The driver circuit may further include a switch coupled to the load, the switch may be configured to control a flow of current through the load in response to a gate control signal generated by the microcontroller.

The microcontroller may be further configured to generate an enable signal that selectively enables and disables the current regulator.

The control signal may further include a pulse width modulated switch control signal that controls a control switch within the current regulator.

The microcontroller may further include a data communication interface that receives commands for controlling the load current.

It is noted that aspects of the inventive concepts described with respect to one embodiment may be incorporated in a different embodiments although not specifically described relative thereto. That is, all embodiments and/or features of any embodiments can be combined in any way and/or combination. These and other objects and/or aspects of the present inventive concepts are explained in detail in the specification set forth below.

BRIEF DESCRIPTION OF THE DRAWINGS

The accompanying drawings are included to provide a further understanding of the disclosure and are incorporated in and constitute a part of this application. In the drawings.

DETAILED DESCRIPTION

Embodiments of the present inventive concepts now will be described more fully hereinafter with reference to the accompanying drawings. The inventive concepts may, however, be embodied in many different forms and should not be construed as limited to the embodiments set forth herein. Rather, these embodiments are provided so that this disclosure will be thorough and complete, and will fully convey the scope of the inventive concepts to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive concepts. As used herein, the term "and/or" includes any and all combinations of one or more of the associated listed items.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein. Although PWM dimming is commonly used for maintaining consistent color temperature during dimming, it may be desirable to use linear dimming for high lumen applications, such as street lighting, where it is not as important to maintain consistent color temperature while dimming.

Figure 1A:
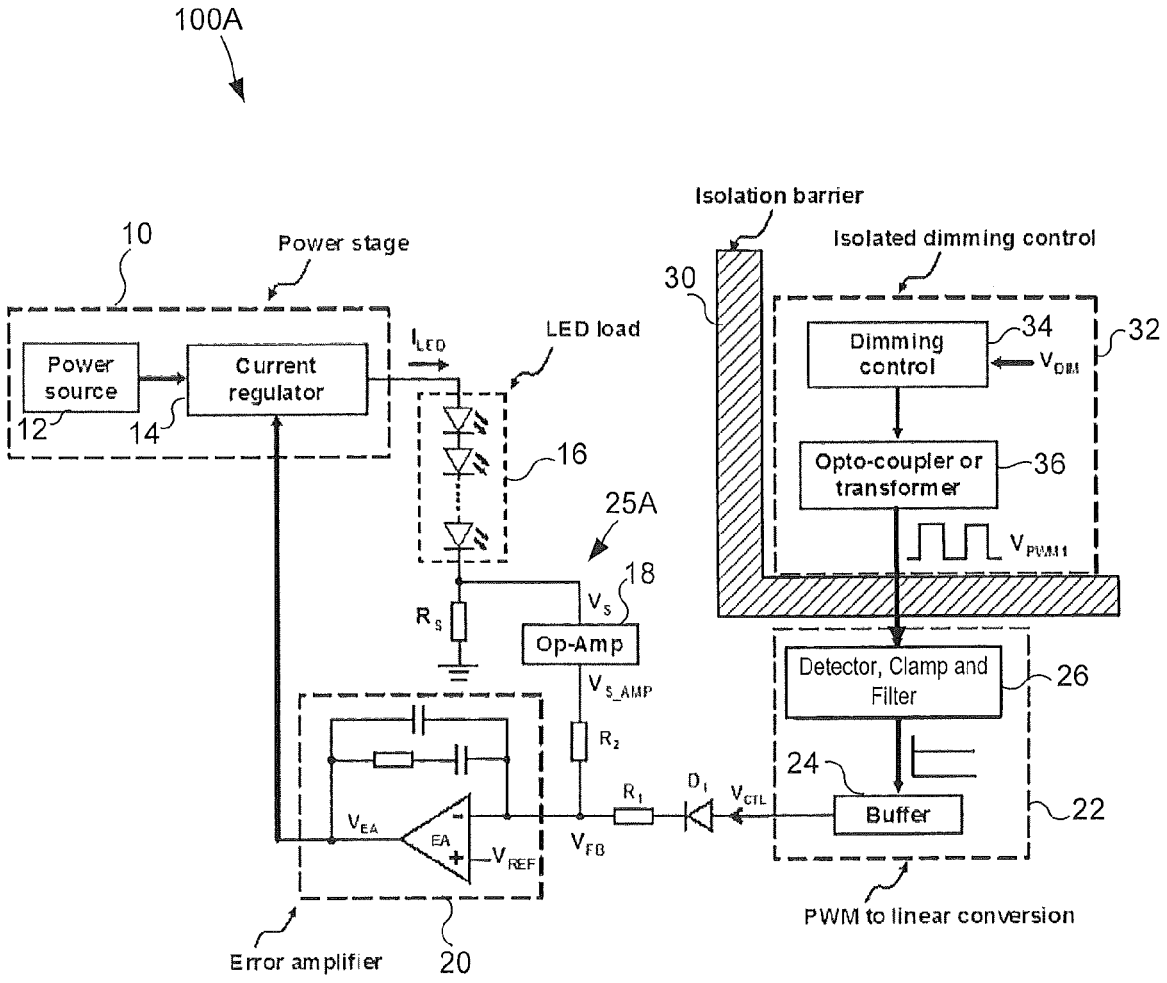
FIG. 1A illustrates an LED driver circuit with linear dimming control according to some embodiments.

FIG. 1A illustrates an LED driver circuit 100A according to some embodiments. In particular, FIG. 1A illustrates an LED driver circuit that provides linear dimming control by adding a dimming control signal to an amplified current-sensing signal.

The LED driver circuit 100A shown in FIG. 1A includes a power stage 10, a PWM to linear conversion circuit 22, a feedback circuit including an error amplifier 20, and an LED current sensing and amplifying circuit 25A. A dimming control circuit 32 provides a dimming control signal, such as a pulse width modulated (PWM) dimming control signal $V_{PWM1}$, to the LED driver circuit 100A. The dimming control circuit 32 can be isolated or non-isolated based on the application requirements, but an isolated dimming control circuit may be desirable for high-voltage LED lighting to avoid hazardous electrical shock. Accordingly, as shown in FIG. 1A, the dimming control signal 32 may be galvanically isolated from the LED driver circuit 100A by an isolation barrier 30, which may include a transformer, an opto-coupler, etc.

The power stage 10 accepts a power source 12, which may include either a DC or an AC source, and provides a constant current for an LED load 16 via a current regulator 14. The current regulator 14 may be a single-stage or multiple-stage converter. A typical current regulator may be a boost PFC (power-factor-correction) stage followed by a DC/DC stage with constant current regulation. The DC/DC stage may be a flyback, an LLC circuit, or any other half/full bridge circuit. The LED load 16 may include a string or multiple strings of LEDs in series, or multiple LEDs connected in a parallel or series/parallel arrangement.

The isolation barrier 30 provides a physical spacing and galvanic isolation between the dimming control circuit 32 and the driver circuit 100A. The spacing is typically a few millimeters up to 10 millimeters, or even higher depending on the voltage differences between these two circuits.

The isolated dimming control circuit 32 receives a dimming control signal $V_{DIM}$, which may, for example, be provided by a low voltage source or a commercially available 0-10V dimmer. In response to the dimming control signal $V_{DIM}$, the isolated dimming control circuit 32 generates a PWM signal $V_{PWM1}$ that is coupled to the PWM to linear conversion circuit 22 via an isolated coupling device, such as transformer or an opto-coupler, which provides electrical isolation between the dimmer control circuit 32 and the driver circuit 100A.

The PWM to linear conversion circuit 22 generates a control signal $W_{CTL}$ in response to the dimming control signal $V_{DIM}$ using a voltage clamp/filtering circuit 26 and a buffer circuit 24.

Figure 11A:
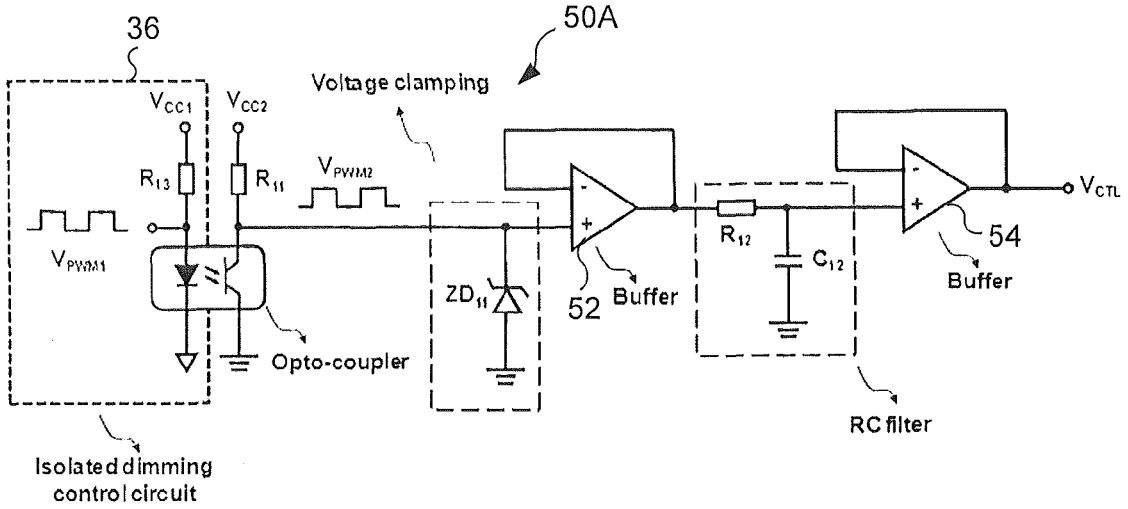
FIGS. 11A and 11B illustrate voltage clamp and filtering circuits according to some embodiments.
Figure 11B:
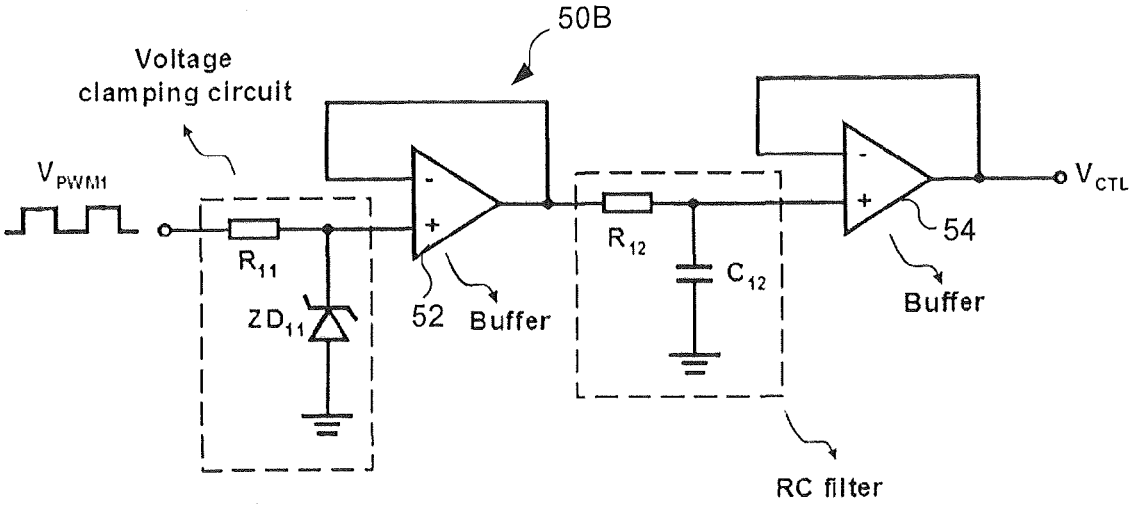

Examples of suitable voltage clamping and filtering circuits are shown in FIGS. 11A and 11B. Referring to FIG. 11A, a voltage clamping and filtering circuit 50A receives a pulse width modulated optical signal $V_{PWM1}$ generated by the opto-coupler circuit 36 in the dimming control circuit 32 (see FIG. 1A) and converts it to a second PWM signal $V_{PWM2}$. A zener diode $ZD_{11}$ clamps the amplitude of the PWM signal $V_{PWM2}$ to a desired value. The resulting signal is buffered by a buffer 52 and filtered by a RC filter including a resistor R12 and capacitor C12. A DC signal is obtained at one terminal of capacitor C12. The DC signal is then coupled to the input of a second buffer 54, the output of which is the control signal $V_{CTL}$.

The circuit of FIG. 11B is similar to the circuit of FIG. 11A, except that the PWM voltage $V_{PWM1}$ is provided directly to the voltage clamping and filtering circuit without a transformer or an opto-coupler.

The output of the PWM to linear conversion circuit 22 is a voltage signal $V_{CTL}$ that is injected (summed) with a voltage generated by the LED current sensing circuit 25A. The LED current $I_{LED}$ is sensed as a voltage $V_S$ that appears across a current-sensing resistor Rs. The voltage $V_S$ is then amplified via an amplifier, such as an op-amp 18. An amplified sense signal $V_{S_AMP}$ is obtained at the output of the op-amp 18. The op-amp 18 is coupled to a combining node $V_{FB}$ through a resistor R2. The control signal $V_{CTL}$ is coupled to the combining node $V_{FB}$ through a resistor R1 and a diode D1. The combining node $V_{FB}$ is coupled to the inverting input of the error amplifier 20.

Thus, the two signals $V_{CTL}$ and $V_{S_AMP}$ are applied to the inverting terminal of the error amplifier 20.

The controlled LED current $I_{LED}$ that drives the LED load is given by Equation [1] as follows:

$$I_{LED} = \frac{1}{kR_sR_1}[V_{REF}(R_1 + R_2) + R_2V_{D1} - R_2V_{CTL}] \quad [1]$$

where k is the gain of the op-amp 18, i.e., $V_{S_AMP}=kV_S$, $V_{REF}$ is a fixed reference voltage, and $V_{D1}$ is the forward voltage drop of diode D1. In equation [1], all parameters except $V_{CTL}$ may be considered to be constant.

In general, an error amplifier may be used to provide feedback control of an output voltage signal. The output voltage of a circuit is scaled, fed back and compared to a stable reference voltage. A difference between the scaled output voltage and the reference voltage generates a compensating error voltage which is used to adjust (correct) the output voltage.

In the embodiment shown in FIG. 1A, the controlled output voltage is the voltage across the current sensing resistor $R_S$. The error amplifier 20 generates an error signal $V_{EA}$ by comparing the sum of the sensed voltage $V_{S_AMP}$ and control voltage $V_{CTL}$ with a reference voltage $V_{REF}$ and the current regulator adjusts the output current so that $V_{FB}$ at the inverting terminal of the error amplifier is as close to the reference voltage $V_{REF}$ as possible.

Since $V_{REF}$ is fixed such that $V_{FB}=V_{REF}$, the voltage $V_S$, and hence the output current $I_{LED}$, is regulated based on $V_{REF}$ and $V_{CLT}$, as expressed by equation [1].

Accordingly, the output $V_{REF}$ of the error amplifier 20 serves as a control signal that controls the duty cycle and/or switching frequency of the current regulator 14. Thus, the regulated current $I_{LED}$ generated by the current regulator 14 can be increased or decreased in response to the dimming control signal $V_{DIM}$ input to the dimming control circuit 32. As the control signal $V_{CTL}$ increases, the amplitude of the LED current $I_{LED}$ drops linearly at a rate of $$\frac{R_2}{kR_sR_1}.$$

Thus, since $V_{CTL}$ is linearly controlled by the level of $V_{DIM}$, the amplitude of the LED current $I_{LED}$ is controlled by $V_{DIM}$ in a linear fashion. The load current $I_{LED}$ is a constant current.

Figure 1B:
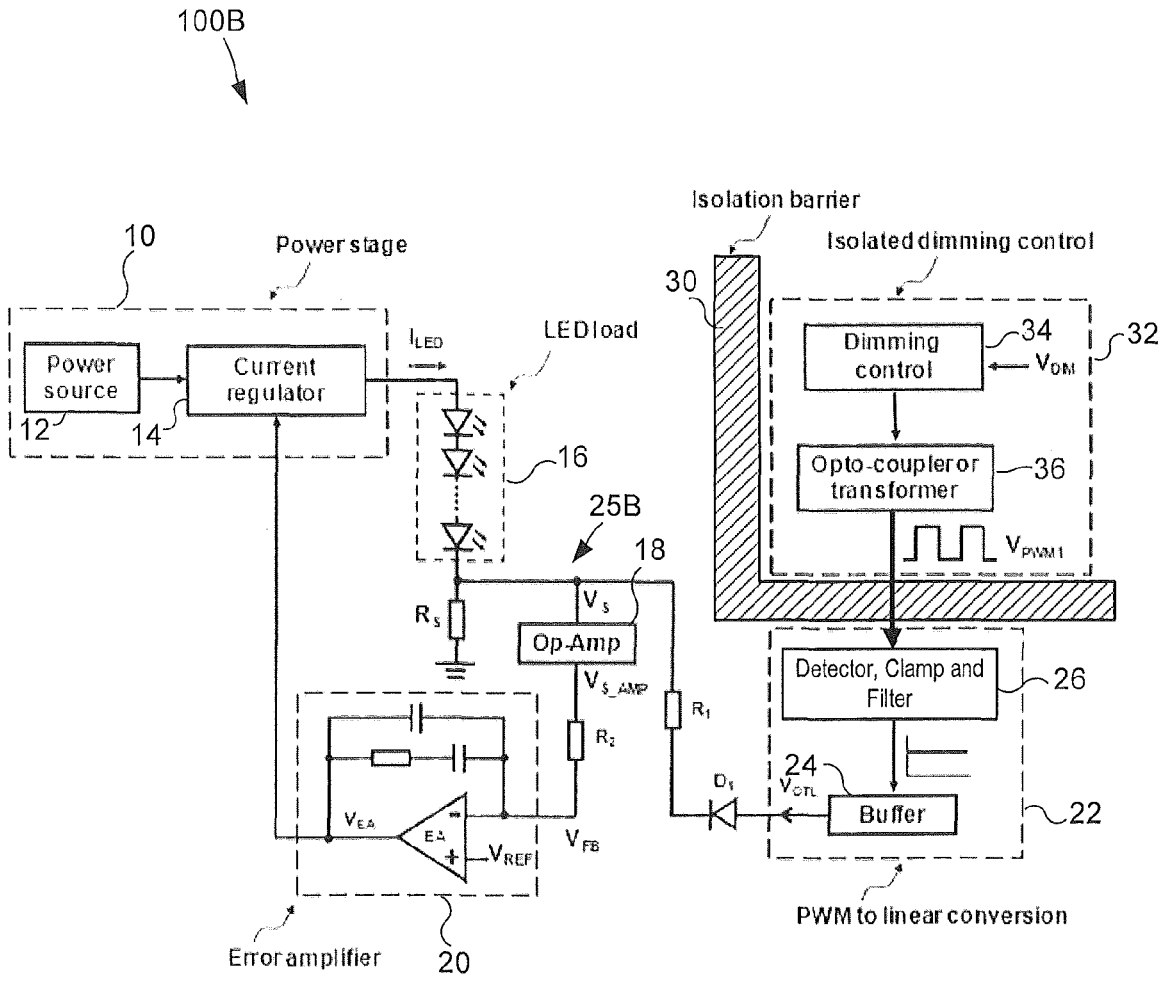
FIG. 1B illustrates an LED driver circuit with linear dimming control according to further embodiments.

FIG. 1B illustrates an LED driver circuit 100B according to some embodiments that provides isolated linear dimming control by adding the dimming control signal $V_{CTL}$ to a sensed current signal at the input of the op-amp 18 in an LED current sensing and amplifying circuit 25B. That is, the output of the PWM to linear conversion circuit 22, i.e., the dimming control signal $V_{CTL}$, is applied to the input of the op-amp 18 along with the sensed current signal from the sense resistor $R_S$ as shown in FIG. 1B. Thus, the voltage $V_S$ at the input to the op-amp 18 is the sum of the sensed current signal, which is equal to $I_{LED}\cdot R_S$, and the divided voltage of $V_{CTL}$ obtained through a voltage divider including resistors R1 and $R_S$. Thus, as $V_{CTL}$ increases, the LED current $I_{LED}$ drops, and vice versa.

Figure 2:
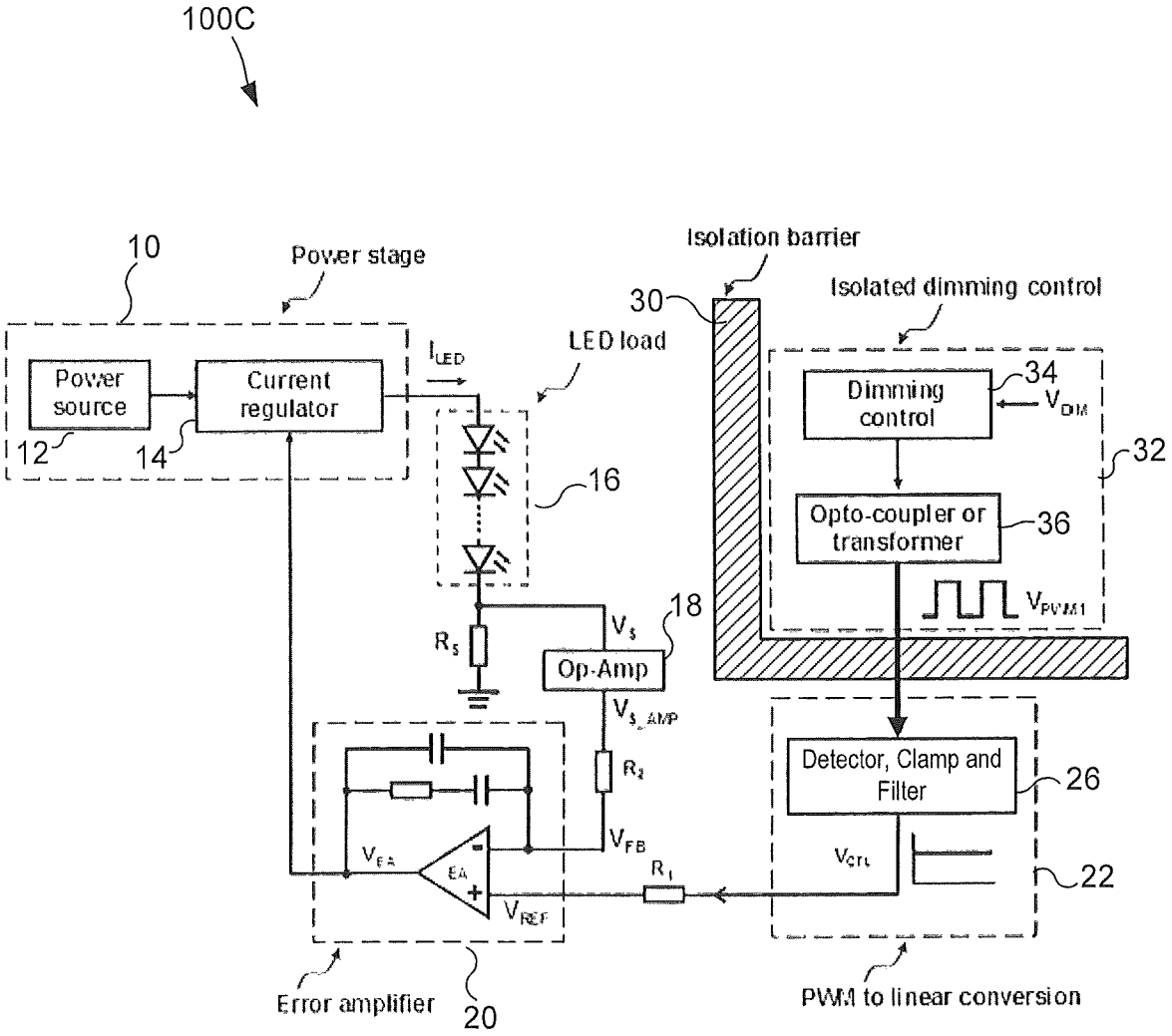
FIG. 2 illustrates an LED driver circuit with linear dimming control according to further embodiments.

FIG. 2 illustrates an LED driver 100C according to some embodiments that provides isolated linear dimming control by varying a current reference signal $V_{REF}$ using a voltage clamp and filtering circuit 26. Instead of adding a control signal to the inverting terminal of the error amplifier 20 as in the embodiments of FIG. 1A and FIG. 1B, in the LED driver circuit 100C, the dimming control signal $V_{DIM}$ is converted to a DC control signal $V_{CTL}$ that is applied to the non-inverting terminal of the error amplifier 20 through a resistor R1. As $V_{CTL}$ increases, $V_{REF}$ also increases, which increases the LED current $I_{LED}$.

Figure 3:
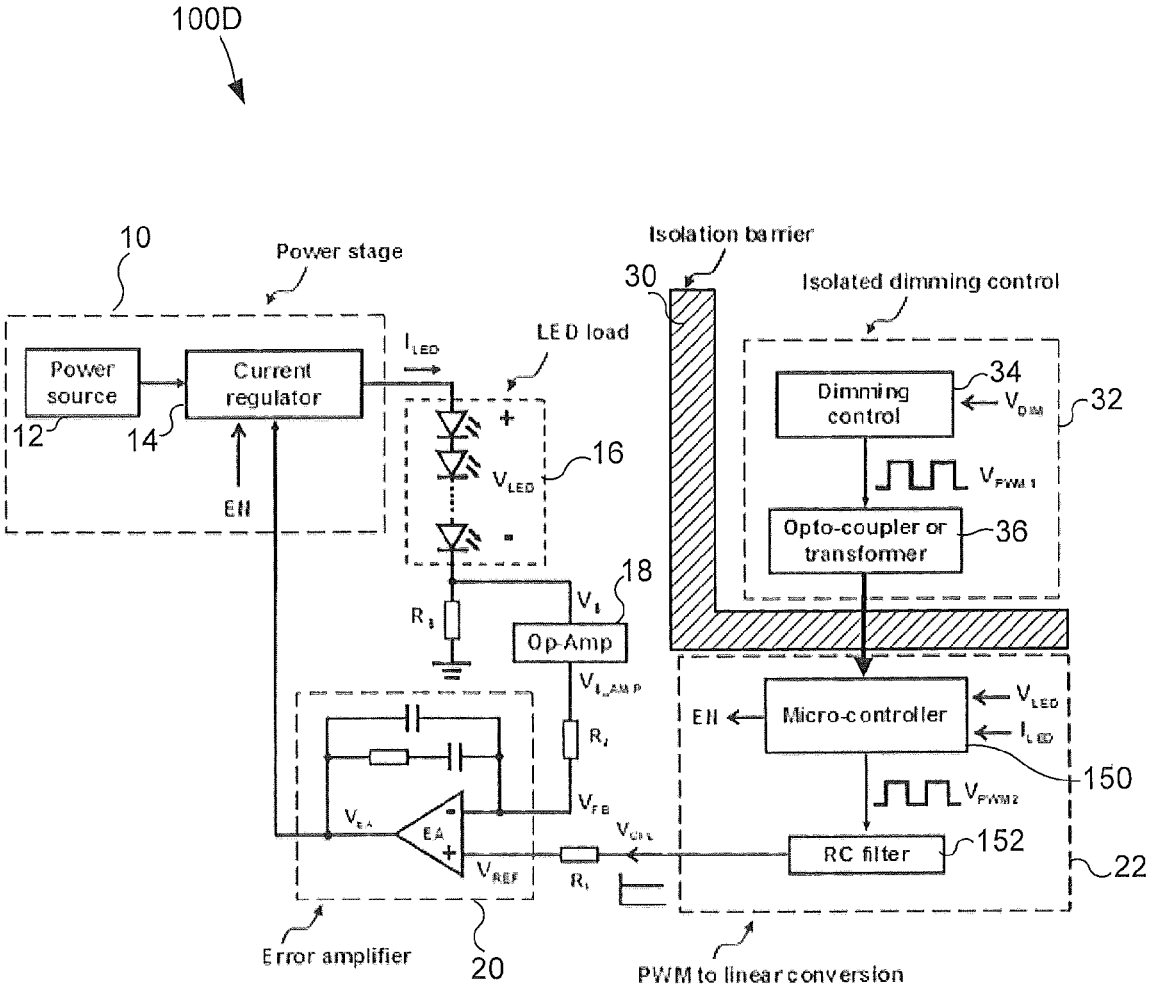
FIG. 3 illustrates an LED driver circuit with microcontroller-based linear dimming control according to some embodiments.

FIG. 3 illustrates an LED driver circuit 100D according to some embodiments that uses a microcontroller to provide linear dimming control. In the LED driver circuit 100D, a microcontroller 150 detects the PWM signal $V_{PWM1}$ from the isolated dimming control circuit 32 and responsively generates a PWM signal $V_{PWM2}$ which is used to generate the current reference signal $V_{REF}$. The duty cycle of $V_{PWM2}$ may be from 0 to 100%, and the frequency of $V_{PWM2}$ may range from a few hundred Hz to a few kHz or even higher. The PWM signal $V_{PWM2}$ is converted to the DC control signal $V_{CTL}$ via an RC filtering circuit 152. Instead of adding the control signal $V_{CTL}$ to the inverting terminal of the comparator EA in the error amplifier 20, the dimming control signal $V_{CTL}$ is applied to the non-inverting terminal of the error amplifier 20 through the resistor R1. As the control signal $V_{CTL}$ increases, the reference voltage $V_{REF}$ increases, which increases the LED current $I_{LED}$.

Some other benefits of using a microcontroller are that the LED voltage $V_{LED}$ and current $I_{LED}$ can be monitored by the microcontroller, and the driver circuit and LEDs can be protected. For example, if there is a fault, such as an over current or an over voltage, the microcontroller 150 may disable the current regulator via an EN signal generated by the microcontroller 150. The EN signal may be provided to the current regulator 14, and may enable or disable the current regulator 14. For example, during normal operation, EN may be set to HIGH. When there is an abnormal operation, EN may be set to LOW, which stops the flow of current from the current regulator 14 until the fault is removed.

Figure 4:
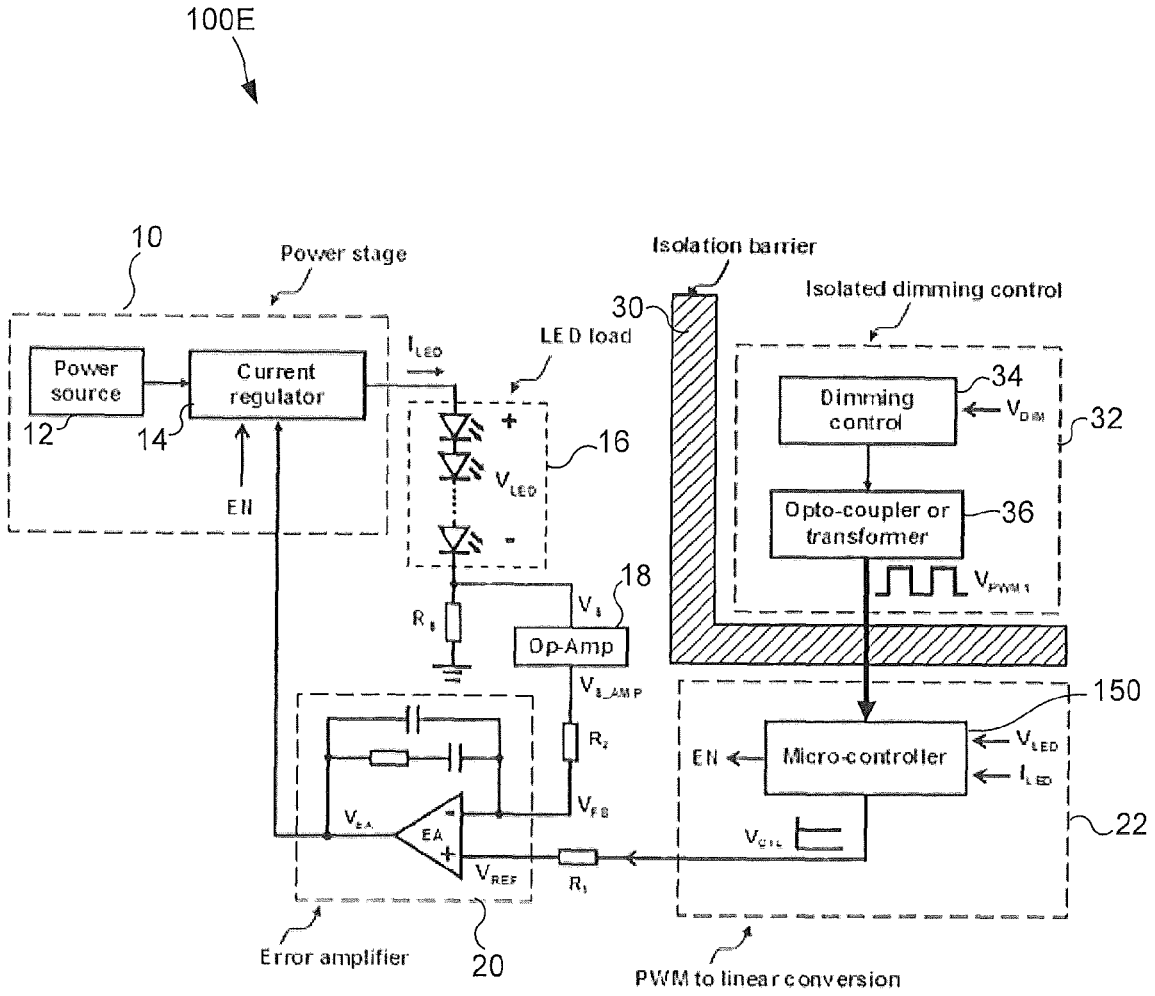
FIG. 4 illustrates an LED driver circuit with microcontroller-based linear dimming control according to further embodiments.

FIG. 4 illustrates an LED driver circuit 100E according to further embodiments. The LED driver circuit 100E includes a microcontroller 150 for linear dimming control by directly generating a control signal $V_{CTL}$ and applying it as the reference voltage $V_{REF}$ to the non-inverting terminal of the error amplifier 20 through the resistor R1. The actual LED current is determined according to Equation [2] as:

$$I_{LED} = \frac{V_{CTL}}{kR_s} \quad [2]$$

Figure 5:
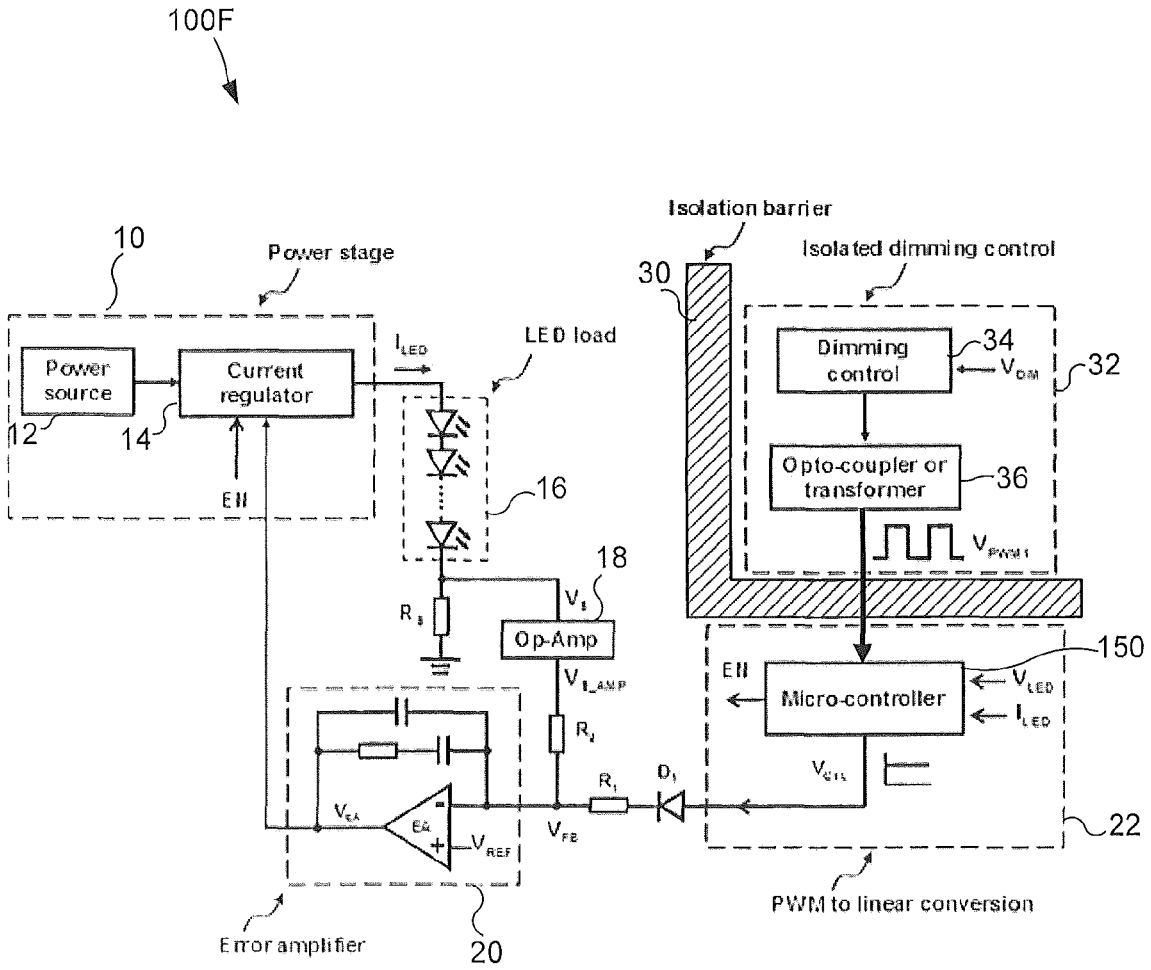
FIG. 5 illustrates an LED driver circuit with microcontroller-based linear dimming control according to further embodiments.

FIG. 5 illustrates an LED driver circuit 100F according to further embodiments that includes a microcontroller 150 for linear dimming control. In the LED driver circuit 100F, the microcontroller 150 directly generates a control signal $V_{CTL}$ and applies it to the summing node $V_{FB}$ through a diode D1 and a resistor R1. The control signal $V_{CTL}$ is summed with the amplified sense voltage $V_{S_AMP}$ at the summing node $V_{FB}$. The resulting voltage at the summing node $V_{FB}$ is applied to the inverting terminal of the error amplifier 20. The actual LED current is determined according to Equation [1].

Figure 6:
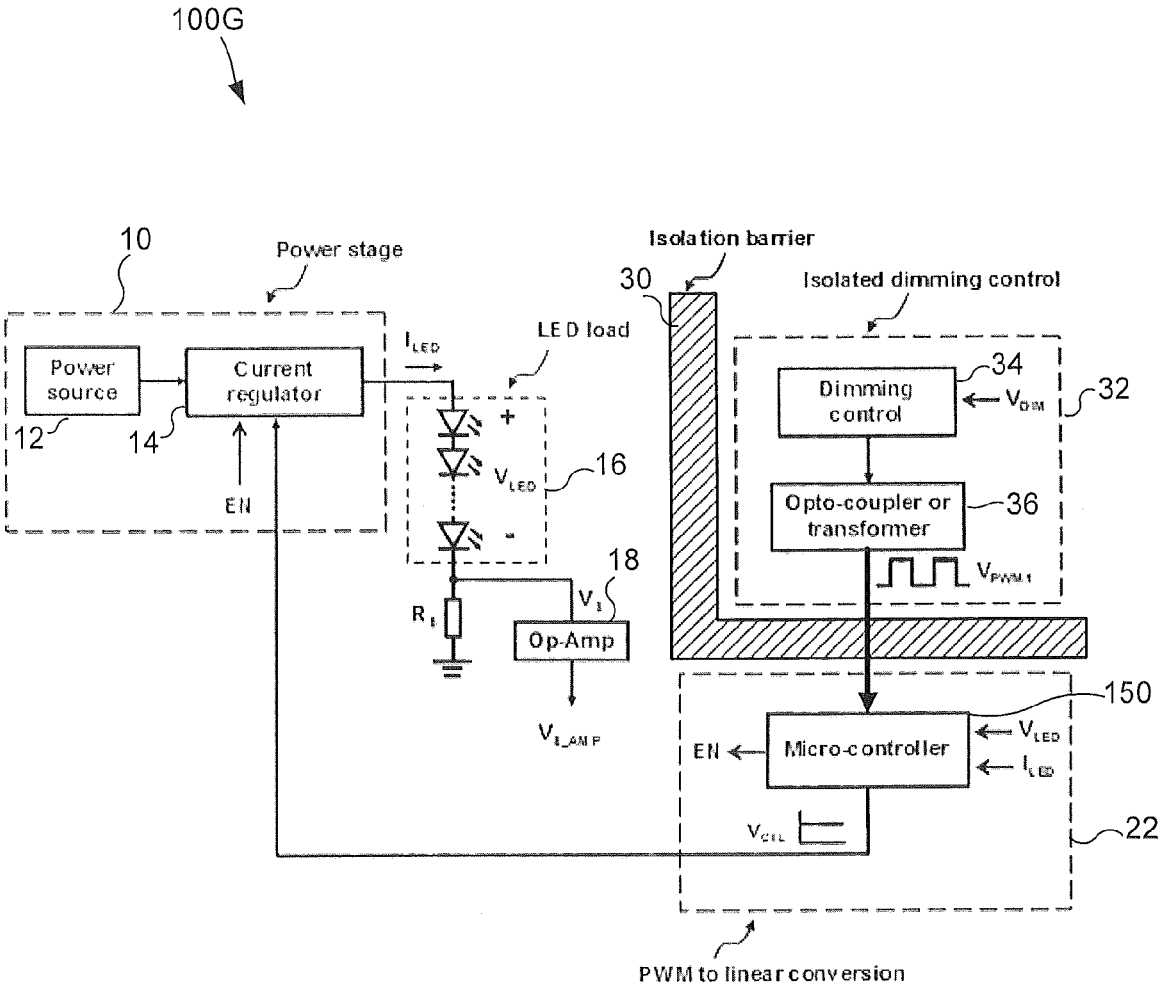
FIG. 6 illustrates an LED driver circuit with microcontroller-based linear dimming control according to further embodiments.

FIG. 6 illustrates an LED driver circuit 100G according to still further embodiments. In the LED driver circuit 100G, the microcontroller 150 performs linear dimming control by directly generating a control signal $V_{CTL}$ that is applied as a control signal to the current regulator 14 without using an error amplifier. The microcontroller 150 senses the LED current $I_{LED}$ and compares it to a reference which is set by the duty cycle of the PWM signal $V_{PWM1}$ generated by the dimming control circuit 32. The LED current $I_{LED}$ is obtained from the voltage on the sense resistor $R_S$. In this manner, the microcontroller 150 can directly control the operation of the current regulator 14.

Figure 7:
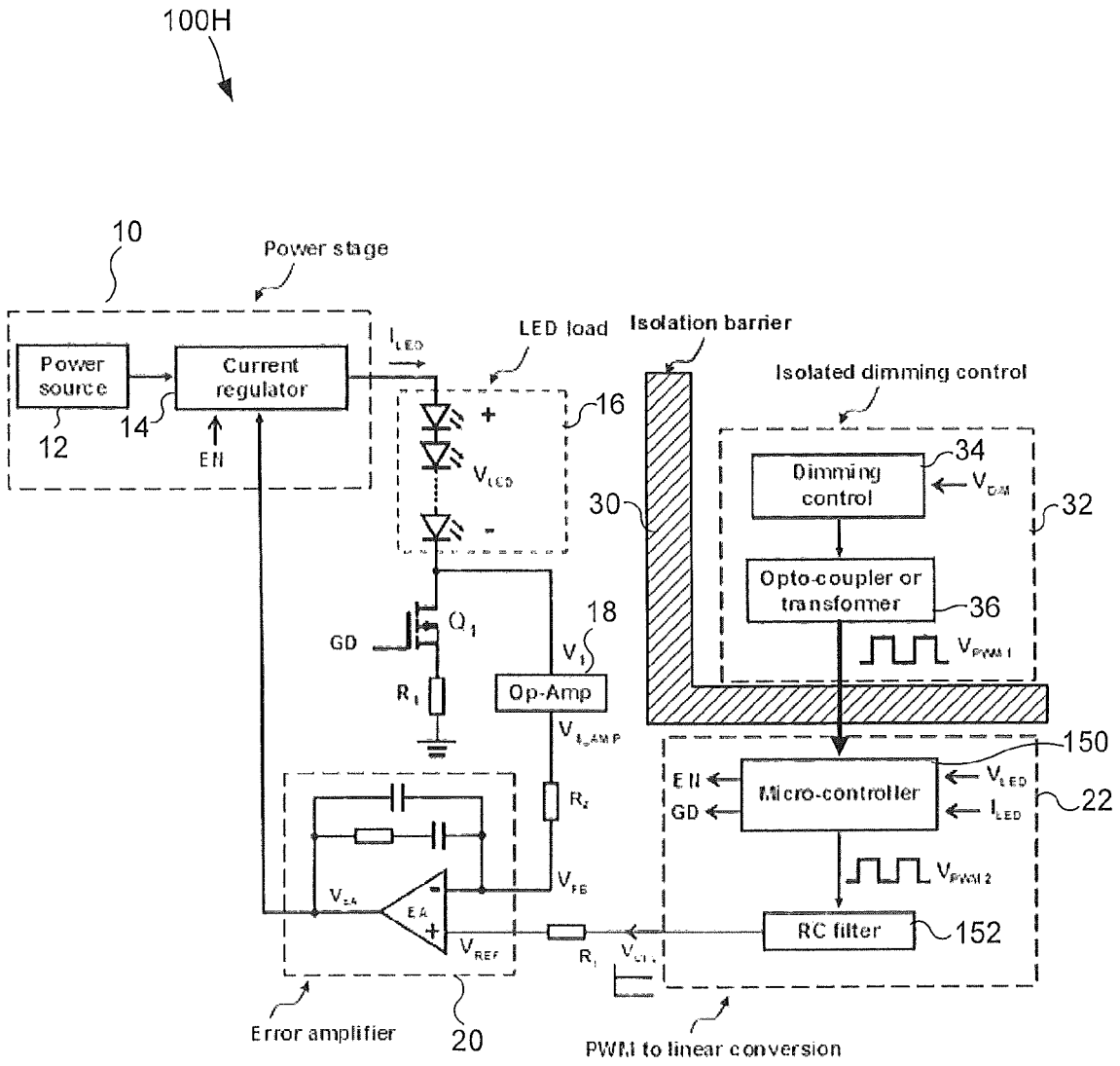
FIG. 7 illustrates an LED driver circuit with microcontroller-based linear dimming control according to further embodiments.

FIG. 7 illustrates an LED driver circuit 100H according to further embodiments. In the LED driver circuit 100H, a protection switch Q1 is coupled in series with the LED load 16 and the sense resistor $R_S$. The microcontroller 150 generates the control signal $V_{CTL}$ and a protection control signal GD. The microcontroller 150 detects the PWM signal $V_{PWM1}$ from the isolated dimming control circuit 32 and generates a second PWM signal $V_{PWM2}$ with a selected duty cycle and frequency. The duty cycle of $V_{PWM2}$ may be from 0 to 100%, and the frequency of $V_{PWM2}$ may range from a few hundred Hz to a few kHz or even higher. The microcontroller 150 monitors the voltage $V_{LED}$ and current $I_{LED}$ of the LED load 160 and activates the protection control signal GD in the event of a fault. The driver circuit 100H and the LEDs in the LED load 16 can thereby be protected against faults. For example, if there is a fault, such as an over current, output short circuit, or an over voltage, the microcontroller 150 may disable the current regulator 14 via the EN signal and set the protection signal GD to HIGH or LOW depending on the required turn-off signal requirement to immediately turn off the protection switch Q1 and stop the flow current through the LED load 16.

In the LED driver circuit 100H shown in FIG. 7, the protection signal GD may be set to LOW to turn off the protection switch Q1. The location of the protection switch Q1 may be at the high side, i.e., at the positive terminal of the LED load, or somewhere between the LEDs as long as the LED current can be blocked once it is turned off.

Figure 8:
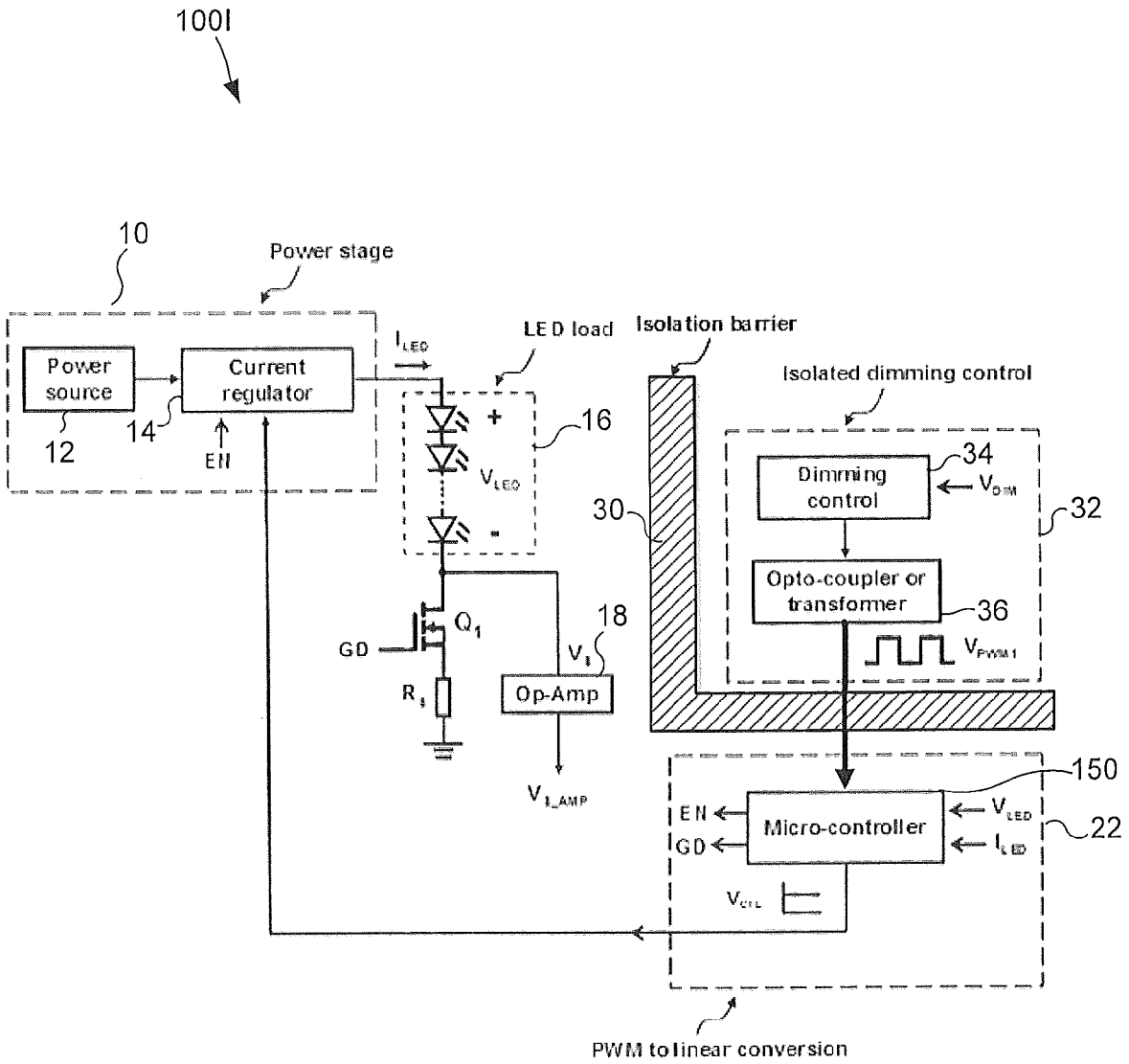
FIG. 8 illustrates an LED driver circuit with microcontroller-based linear dimming control according to further embodiments.

FIG. 8 illustrates an LED driver circuit 100I according to further embodiments. The LED driver circuit 100I includes a protection switch Q1 which is controlled by protection control signal GD and a microcontroller 150 for generating a control signal $V_{CTL}$ that directly controls the current regulator 14. The microcontroller 150 also monitors the LED current $I_{LED}$ and voltage $V_{LED}$, and protects the LED driver circuit 100I from over current or over voltage, or an output short circuit. An error amplifier is not needed in this embodiment, since the microcontroller 150 is responsible for comparing the actual LED current $I_{LED}$ with a set level that is determined by the dimming control signal $V_{DIM}$, and for generating the control signal $V_{CTL}$ that controls the current regulator 14.

Figure 9:
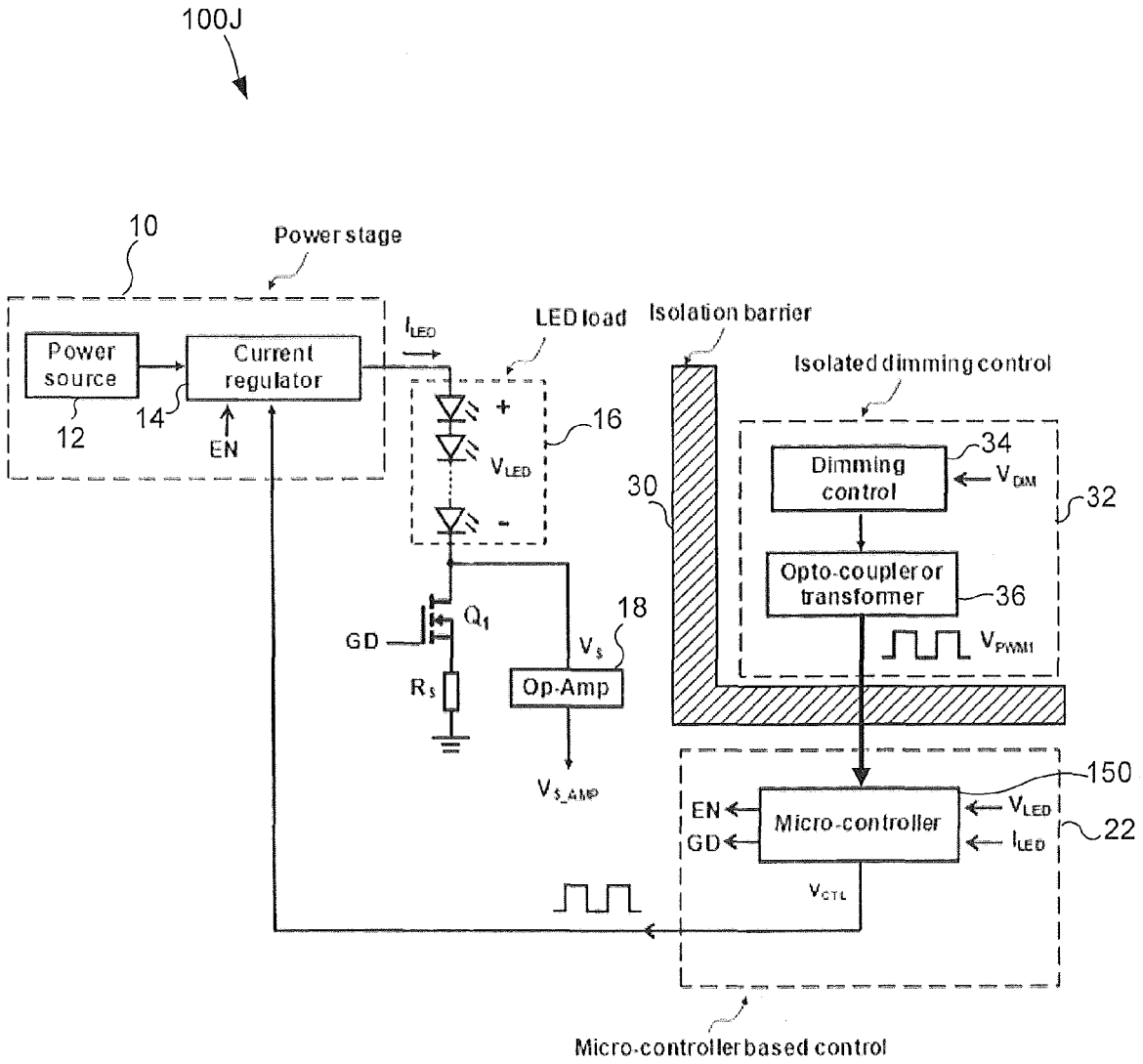
FIG. 9 illustrates an LED driver circuit with microcontroller-based linear dimming control according to further embodiments.

FIG. 9 illustrates an LED driver circuit 100J according to still further embodiments. The LED driver circuit 100J includes a protection switch Q1 which is controlled by protection control signal GD that is generated by a microcontroller 150. The microcontroller 150 also generates a gate control signal $V_{CTL}$ that controls the turn-on or turn-off of a control switch in the current regulator 14. The duty cycle or frequency of the control signal $V_{CTL}$ may be varied to adjust the output current of the current regulator 14, which changes the brightness of the LEDs.

Figure 12:
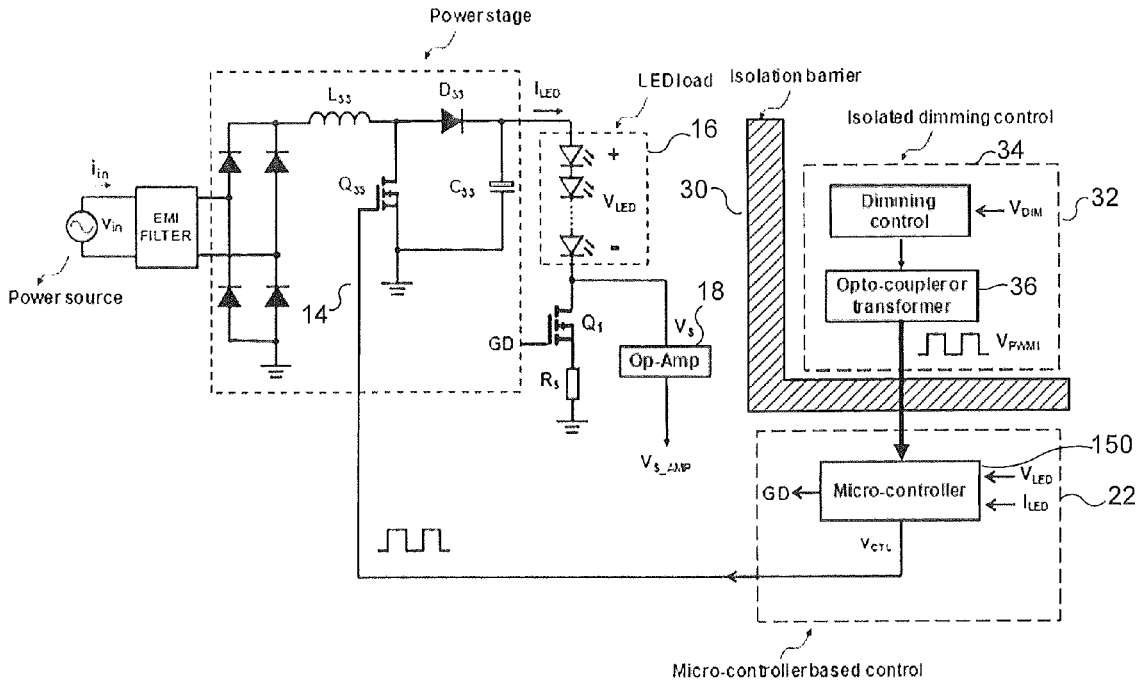
FIG. 12 illustrates an LED driver circuit with a current regulator circuit according to some embodiments.

An exemplary driver circuit in which the gate control signal $V_{CTL}$ is used to directly control the turn-on or turn-off of a control switch in the current regulator 14 is shown in FIG. 12. The current regulator 14 is a boost converter including a boost inductor L33, switch Q33, diode D33, and output capacitor C33. The switch Q33 is turned on or off by a control signal from the micro-controller. In fact, the power stage can be any switching current regulator, such as a buck, flyback, buck-boost, or any others.

Another benefit of using the microcontroller 150 in an LED driver circuit according to some embodiments is that the output power, hence the brightness, or lumen level of the LED load 16 can be kept constant regardless of the change of LED string voltage due to manufacturing tolerances, operating temperatures, etc. The microcontroller 150 may adjust the control signal $V_{CTL}$ by monitoring the actual voltage and current of the LED load 16. As the power of the LED load 16 ($I_{LED} \cdot V_{LED}$) decreases, the control signal $V_{CTL}$ may be increased, causing the current regulator 14 to provide a higher output current, thus maintaining the same output power of the LED load 16. On the contrary, as the power consumed by the LED load 16 increases, the control signal $V_{CTL}$ may be decreased, causing the current regulator 14 to provide a lower output current, thus maintaining the same output power of the LED load 16.

Figure 10:
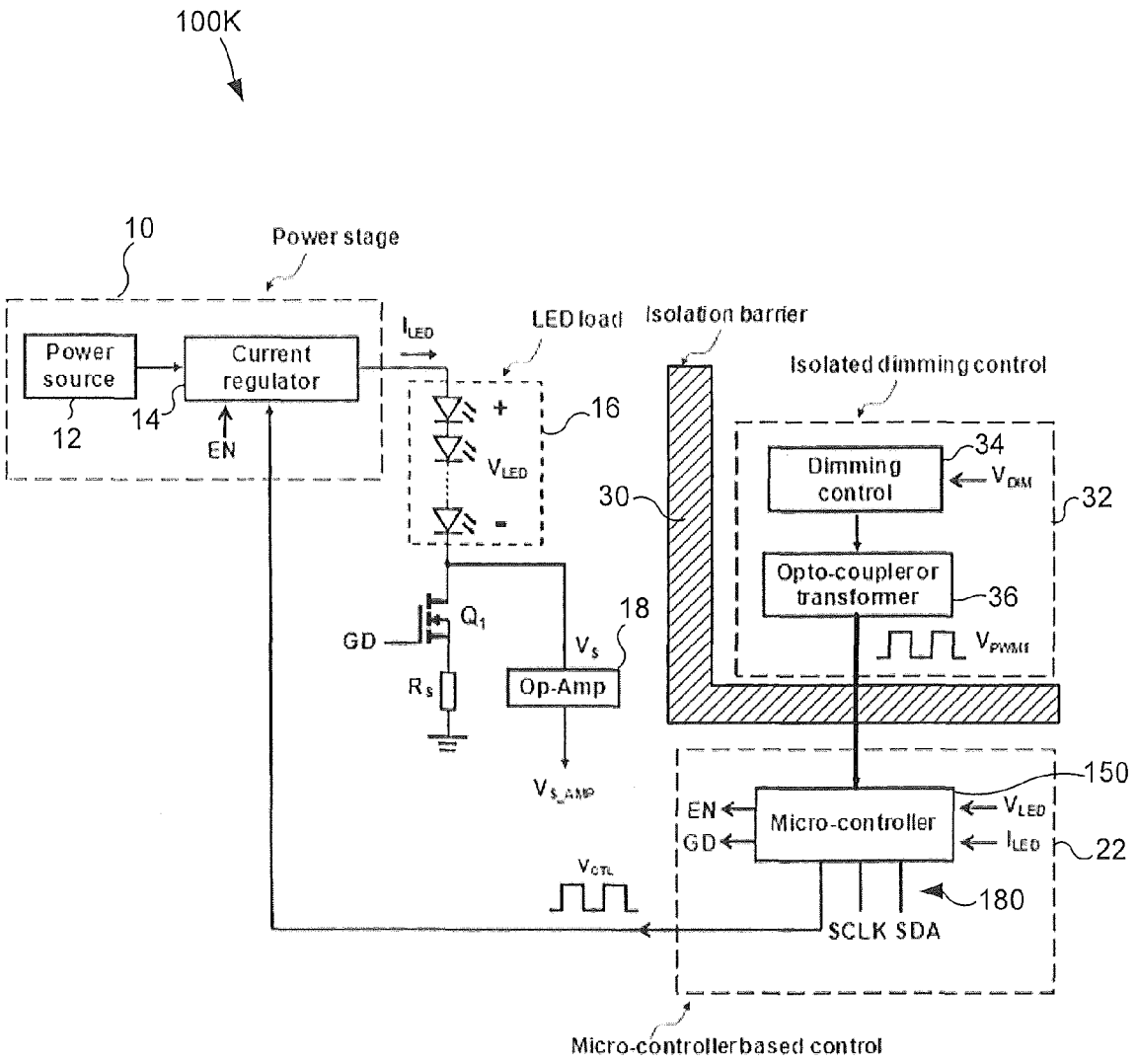
FIG. 10 illustrates an LED driver circuit with microcontroller-based linear dimming control according to further embodiments.

FIG. 10 illustrates an LED driver 100K according to further embodiments that provides a microcontroller 150 that controls dimming by directly controlling the current regulator 14 and provides protection by controlling a protection switch Q1. In addition, the microcontroller 150 is configured to receive and transmit data and/or commands over a data communication interface 180.

Thus, another benefit of using the microcontroller 150 in an LED driver circuit according to some embodiments is that the driver circuit can receive commands and/or send information to a central control center via a data interface 180. The data interface 180 may include a series bus that carries a CLOCK signal, SCLK, and a data signal, SDA, as shown in FIG. 10. The microcontroller 150 is responsible for controlling dimming, regulation of the LED current and power, driver circuit and LED protection, and also responsible for receiving and transmitting data and/or commands to/from the control center.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments and, although specific terms are employed, they are used in a generic and descriptive sense only and not for purposes of limitation, the scope of the inventive concepts being set forth in the following claims.

What is claimed is:

1. A driver circuit for a lighting apparatus, comprising:

a current regulator configured to supply a load current to a load;

a control circuit coupled to the current regulator and configured to receive a dimming control signal and to vary an amplitude of the load current in response to the dimming control signal;

a conversion circuit that is configured to generate a control signal in response to the dimming control signal;

a current sense circuit that is configured to generate a current sense signal indicative of the amplitude of the load current;

a combining node that is configured to combine the current sense signal and the control signal; and an error amplifier that is configured to receive the combined control signal and current sense signal and responsively generate an error signal that controls the current regulator.

2. The driver circuit of claim 1, wherein the error amplifier comprises an inverting input and a noninverting input, the control signal is coupled to the inverting input of the error amplifier through a diode and a first resistor, the current sense signal is coupled to the inverting input of the error amplifier through a second resistor, and a reference voltage is applied to the noninverting input of the error amplifier.

3. The driver circuit of claim 1, wherein the dimming control signal comprises a pulse width modulated signal, and wherein the conversion circuit is configured to receive the pulse width modulated dimming control signal and to generate the control signal in response to the pulse width modulated dimming control signal.

4. The driver circuit of claim 3, wherein the conversion circuit comprises a detector configured to detect the pulse width modulated dimming control signal and a voltage clamp and filler circuit coupled to the detector and configured to clamp and filter an output of the detector.

5. The driver circuit of claim 1, wherein the error amplifier comprises an inverting input and a noninverting input, the control signal is coupled to a first node through a diode and a first resistor, the current sense signal is coupled to the first node, the first node is coupled to an input of an amplifier, an output of the amplifier is coupled to the inverting input of the error amplifier through a second resistor, and a reference voltage is applied to the noninverting input of the error amplifier.

6. The driver circuit of claim 1, wherein the error amplifier comprises an inverting input and a noninverting input, the control signal is coupled to the noninverting input of the error amplifier through a first resistor, and the current sense signal is coupled to the inverting input of the error amplifier through a second resistor.

7. The driver circuit of claim 1, wherein the control circuit comprises:

a microcontroller that is configured to generate a control signal in response to the dimming control signal.

8. The driver circuit of claim 7, wherein the error amplifier comprises an inverting input and a noninverting input, the control signal is coupled to the noninverting input of the error amplifier through a first resistor, and the current sense signal is coupled to the inverting input of the error amplifier through a second resistor.

9. The driver circuit of claim 7, wherein the microcontroller is configured to generate a pulse width modulated control signal in response to the dimming control signal, the control circuit further comprising a filter configured to convert the pulse width modulated control signal into a voltage control signal.

10. The driver circuit of claim 7, wherein the microcontroller is configured to generate the control signal as a voltage control signal.

11. The driver circuit of claim 10, wherein the error amplifier comprises an inverting input and a noninverting input, the control signal is coupled to the noninverting input of the error amplifier through a first resistor, and the current sense signal is coupled to the inverting input of the error amplifier through a second resistor.

12. The driver circuit of claim 10, wherein the error amplifier comprises an inverting input and a noninverting input, the control signal is coupled to the inverting input of the error amplifier through a diode and a first resistor, the current sense signal is coupled to the inverting input of the error amplifier through a second resistor, and a reference voltage is applied to the noninverting input of the error amplifier.

13. The driver circuit of claim 10, wherein the voltage control signal is provided directly to the current regulator as a current regulator control signal.

14. The driver circuit of claim 7, further comprising a switch coupled to the load, wherein the switch is configured to control a flow of current through the load in response to a gate control signal generated by the microcontroller.

15. The driver circuit of claim 7, wherein the microcontroller is further configured to generate an enable signal that selectively enables and disables the current regulator.

16. The driver circuit of claim 7, wherein the control signal comprises a pulse width modulated switch control signal that controls a control switch within the current regulator.

17. The driver circuit of claim 7, wherein the microcontroller further comprises a data communication interface that receives commands for controlling the load current.

18. A driver circuit for a lighting apparatus, comprising:

a current regulator configured to supply a load current to a load; and a control circuit coupled to the current regulator and configured to receive a dimming control signal;

a current sense circuit that is configured to generate a current sense signal indicative of the amplitude of the load current;

a combining node that is configured to combine the current sense signal and the dimming control signal; and an error amplifier that is configured to receive the combined control signal and current sense signal and responsively generate an error signal that controls the current regulator.

* * * * *

UNITED STATES PATENT AND TRADEMARK OFFICE

CERTIFICATE OF CORRECTION

PATENT NO. : 9,220,146 B2
APPLICATION NO. : 13/932717
DATED : December 22, 2015
INVENTOR(S) : Yuequan Hu It is certified that error appears in the above-identified patent and that said Letters Patent is hereby corrected as shown below:

In the Specification
Column 5, Line 8: Please correct "$W_{CTL}$" to read -- $V_{CTL}$ --
Column 6, Line 3: Please correct "$V_{CLT}$," to read -- $V_{CTL}$, --
Column 6, Line 4: Please correct "$V_{REF}$" to read -- $V_{EA}$ --

Signed and Sealed this
Fifth Day of July, 2016

Michelle K. Lee

Michelle K. Lee
*Director of the United States Patent and Trademark Office*